US008424695B2

(12) United States Patent
Buono

(10) Patent No.: US 8,424,695 B2
(45) Date of Patent: Apr. 23, 2013

(54) SPRING ACTION CHILD RESISTANT CLOSURE AND CONTAINER

(75) Inventor: Caetano Buono, Staten Island, NY (US)

(73) Assignee: Van Blarcom Closures, Inc., Brooklyn, NY (US)

( * ) Notice: Subject to any disclaimer, the term of this patent is extended or adjusted under 35 U.S.C. 154(b) by 0 days.

(21) Appl. No.: 13/166,633

(22) Filed: Jun. 22, 2011

(65) Prior Publication Data

US 2012/0325816 A1 Dec. 27, 2012

(51) Int. Cl.
*B65D 55/02* (2006.01)
*B65D 41/36* (2006.01)
*B67D 1/00* (2006.01)

(52) U.S. Cl.
USPC ..... 215/222; 215/332; 215/217; 215/218; 215/219; 215/220; 215/221

(58) Field of Classification Search ..... 215/222, 215/332, 217, 218, 219, 220, 221; 222/80, 222/81, 83
See application file for complete search history.

(56) References Cited

U.S. PATENT DOCUMENTS 4,579,238 A * 4/1986 Herr ..... 215/211
5,379,910 A 1/1995 Montgomery
5,927,529 A 7/1999 Hofmann et al.
6,155,462 A 12/2000 Brecheisen et al.
6,227,390 B1 5/2001 Trzmiel et al.
7,021,477 B2 4/2006 Wolfe
7,036,672 B2 5/2006 Jaycox
7,198,170 B2 4/2007 Herr
7,331,479 B2 2/2008 Oh
7,673,763 B1 3/2010 Oh
7,819,265 B2 10/2010 Brozell
2007/0278173 A1 12/2007 Brozell
2008/0169262 A1 7/2008 Ekkert
2008/0173609 A1 7/2008 Shingle
2008/0257849 A1 10/2008 Farrar et al.

* cited by examiner

*Primary Examiner* — Anthony Stashick
*Assistant Examiner* — Don M Anderson
(74) *Attorney, Agent, or Firm* — Cozen O'Cozen

(57) ABSTRACT

An improved closure for a container. The container includes a lip having a plurality of downwardly extending angled surfaces, each terminating in a recess, and a shoulder which defines an open top of the container. The closure includes a plurality of lugs which are configured to engage the angled surfaces when the closure is rotated and mate with the recesses to secure the closure in place. To secure the tabs in the recesses, the closure includes one or more springs which extend downwardly from the top of the closure and contact the shoulder of the container to urge the closure upwardly with respect to the container. To separate the closure and the container, the closure is pressed toward the open top of the container, thereby disengaging the lugs from the recesses and allowing the rotation of the closure to disengage the closure from the container.

20 Claims, 4 Drawing Sheets

SPRING ACTION CHILD RESISTANT CLOSURE AND CONTAINER

BACKGROUND OF THE INVENTION

1. Field of the Invention

The invention is directed to a child resistant closure for use with a container, and the combination of such a closure and container and, more particularly, to such a closure and combination where the closure includes springs to urge the closure into a child-resistant configuration.

2. Description of the Related Art

Providing child-resistant closures for medicine containers is a longstanding concern in the field of dispensing medicine and other substances which may be generally helpful, but also must not fall into the hands of small children. People who take medication often live in households with small children, or have small children visit, and so are fearful of having medication containers which can be readily opened by children.

There have been many attempts over the years to provide child-resistant medicine containers, but finding the most effective type of child resistant closure is difficult.

One attempt is shown in U.S. Pat. No. 5,449,078, which discloses a child-resistant closure and container combination in which the container has a series of sloped surfaces on an exterior thereof, each with a recess therein, and the closure has a plurality of tabs which are configured to mate with the recesses. However, in this combination, the tabs are very difficult to disengage from the recesses and, while making the combination child-resistant, it becomes nearly adult-resistant as well, at least for elderly or otherwise frail or impaired adults who might not be able to manage opening the container.

Accessing medicine within a container cannot be made too difficult, because many people who need medicine are elderly or frail (e.g., with arthritis, etc.), and so cannot use closures that require a great deal of strength to open. There must be a tradeoff, therefore, in providing ease of access of container contents to the patient while restricting access to children. This can prove to be an elusive balance, especially given the economics of the marketplace.

A subsequent attempt to strike that balance may be found in U.S. Pat. No. 7,021,477, which discloses a child-resistant closure and container package in which the closure is attached to the container by a plurality of radially inwardly extending spring elements. The spring elements depend from the underside of the top of the closure and then curve around a ledge on the container to grip the container in a radial direction. This configuration, while easier to open than the one described in U.S. Pat. No. 5,449,078 described above, is nonetheless difficult to manufacture.

Those in the art continuously seek improved mechanisms for closures which are child-resistant but which can nonetheless be opened easily by patients who may be elderly, frail or otherwise find it difficult to open medicine containers and yet likewise easy and inexpensive to manufacture.

SUMMARY OF THE INVENTION

It is therefore an object of the invention to provide an improved child-resistant closure for use with a medicine container.

It is a further object of the invention to provide an improved child-resistant closure which allows for the easy and simple opening and closing of the container by adults with some physical impairment while still presenting a closure which is difficult for children to open.

It is another object of the invention to provide a child-resistant closure-and-container combination that is easy to manufacture and assemble, as well as easy for the intended user to use.

In accordance with these and other objects of the invention, there is provided an improved closure and container combination. The container includes a lip having a plurality of downwardly extending angled surfaces, each terminating in a recess, and a shoulder which defines an open top of the container. The closure includes a plurality of lugs or tabs which are configured to engage the angled surfaces when the closure is rotated and to mate with the recesses to secure the closure in place. To secure the lugs or tabs in the recesses, the closure includes one or more springs, which extend downwardly from the top of the closure and contact the shoulder of the container to urge the closure upwardly with respect to the container, thereby seating the tabs in the recesses. To separate the closure from the container, the closure is pressed downward in a direction toward the open top, thereby disengaging the tabs from the recesses and allowing the rotation of the closure to disengage the closure from the container.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, in which like numerals refer to like elements.

DETAILED DESCRIPTION OF THE PRESENTLY PREFERRED EMBODIMENTS

Figure 1:
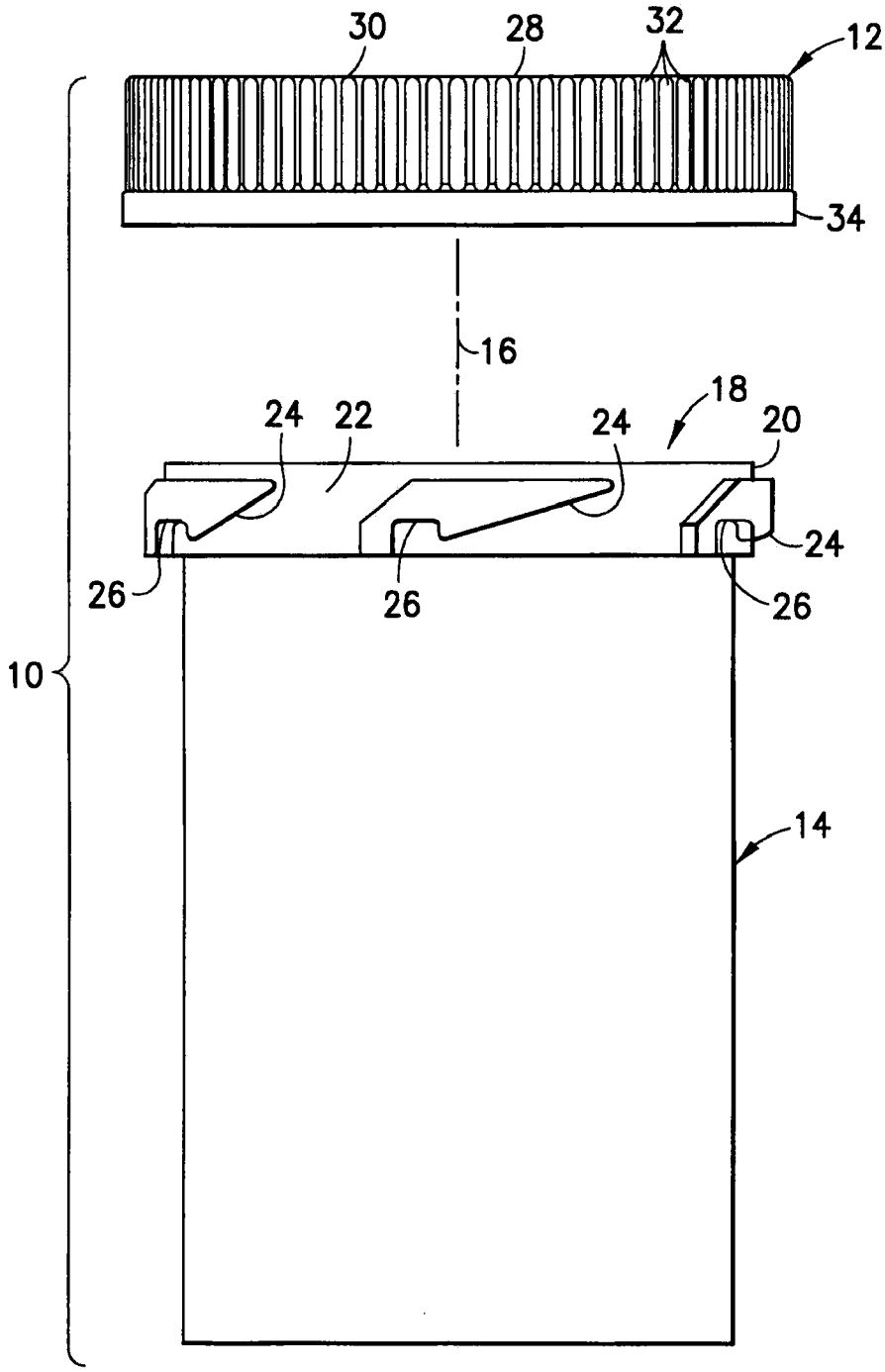
FIG. 1 is an exploded side elevation view of a preferred embodiment of the inventive closure and container combination.

In FIG. 1 there is shown generally at 10 a closure 12 and container 14 combination in accordance with the invention. Container 14 is generally cylindrical, defining an axis 16, and has an open top 18 defined by an annular shoulder 20. In the preferred embodiment, container 14 is used to hold medicine, such as pills, capsules or tablets, but the contents of container 14 is irrelevant to the nature of the invention. At or near open top 18, container 14 includes a lip 22 on which are located a plurality of angled or sloped surfaces 24. Each angled surface 24 slopes downwardly from proximate the open top 18 towards a downwardly opening recess 26. Lip 22 extends radially outward from container 14, and angled surfaces 24 are preferably distributed evenly about the periphery of container 14, with some spaces therebetween. The number of angled surfaces is a mere matter of design choice but, in the preferred embodiment, there are five angled surfaces 24 equally spaced about the periphery.

Figure 2:
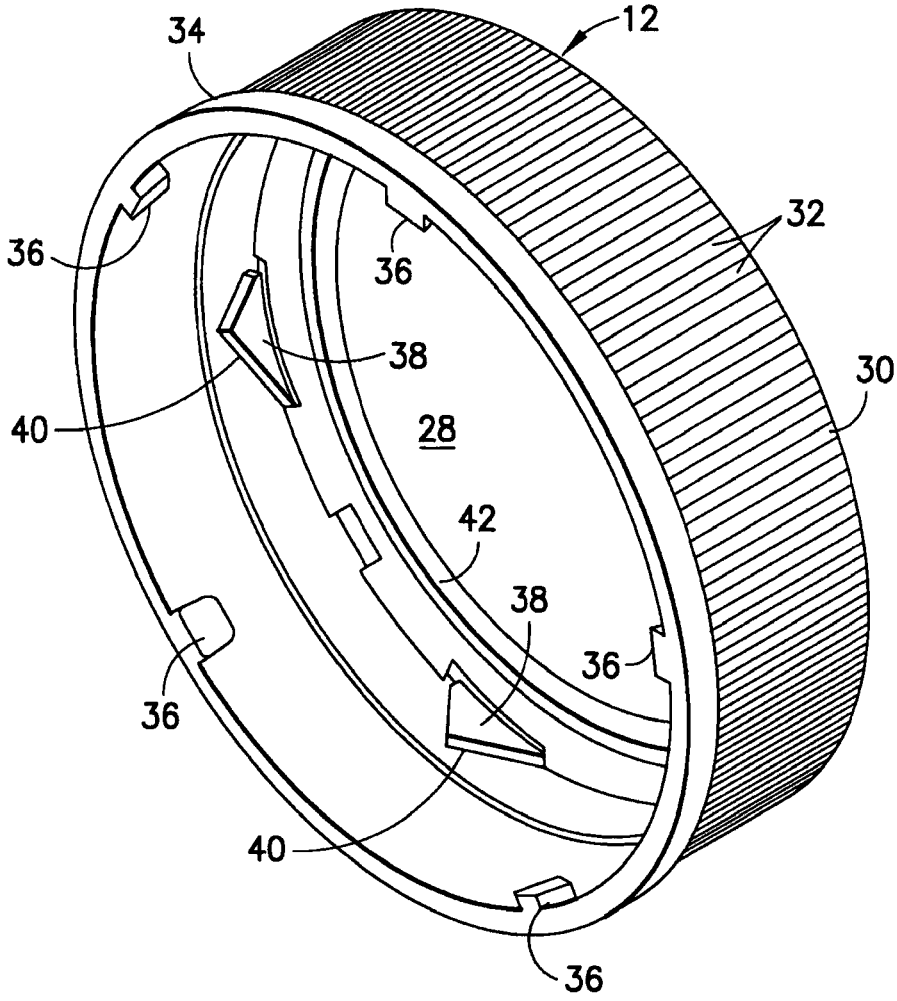
FIG. 2 is a bottom perspective view of the closure of FIG. 1.
Figure 3:
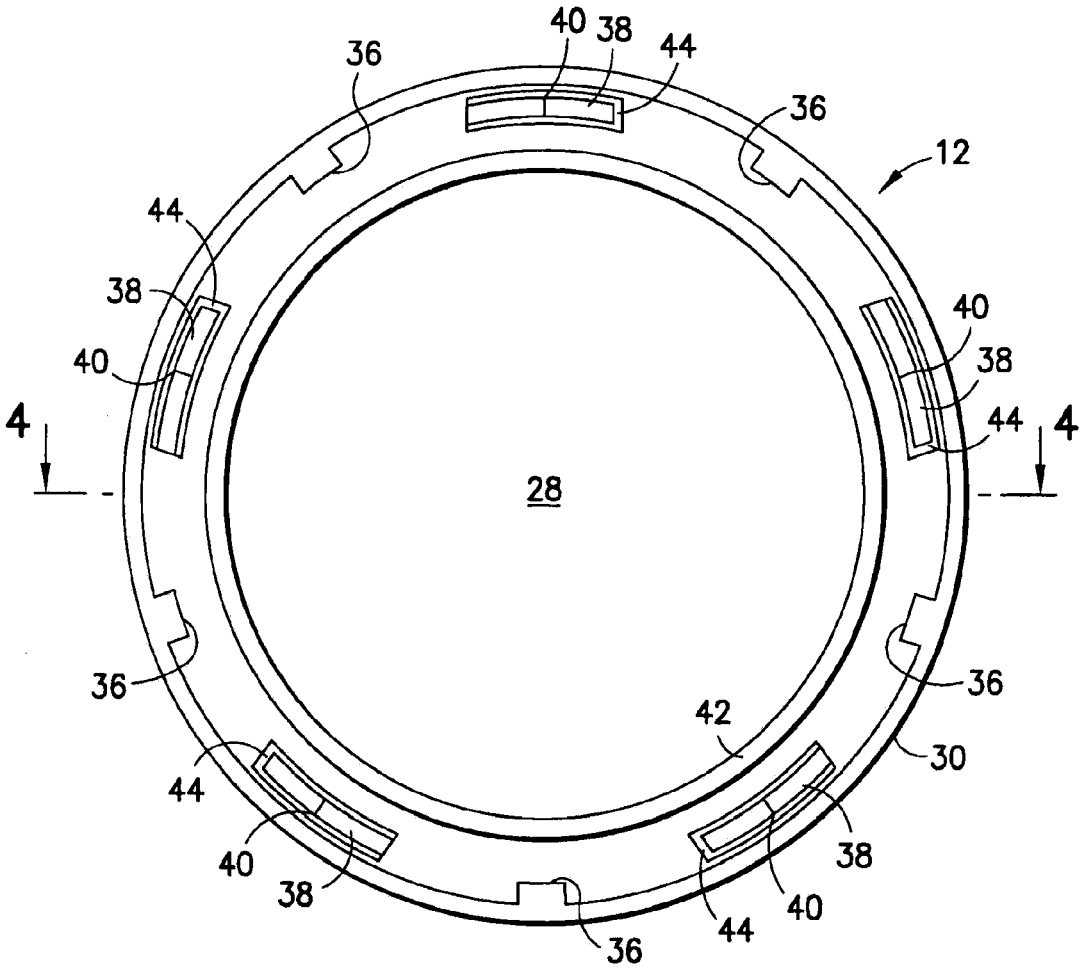
FIG. 3 is a bottom plan view of the closure of FIG. 1.
Figure 4:
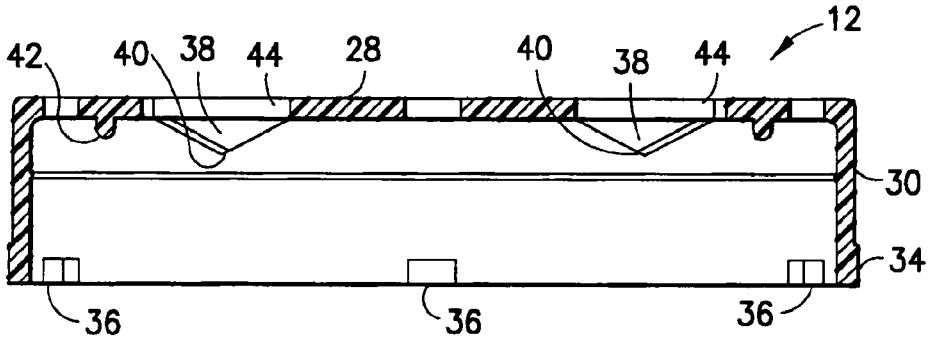
FIG. 4 is a side cross-section view of the closure of FIG. 1.
Figure 5:
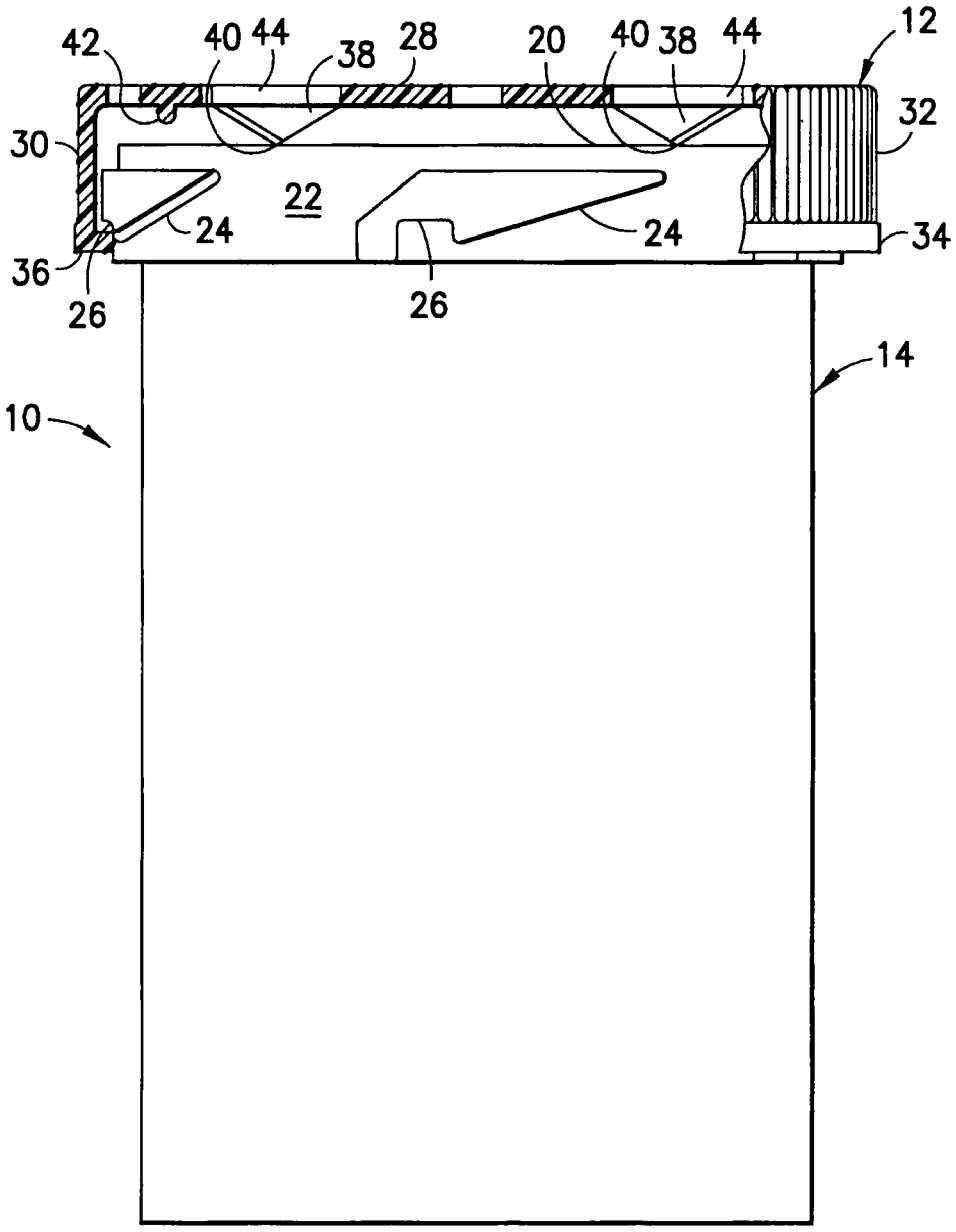
FIG. 5 is a side elevation view of the assembled combination of FIG. 1, shown partly in breakaway, illustrating the closure and container when joined together.

With reference to FIGS. 2-4, closure 12 has a generally circular top 28 which covers top 18 of container 14 when closure 12 and container 14 are joined (as in FIGS. 1 and 5). The center of top 28 lies along axis 16 when closure 12 and container 16 are joined together. A skirt 30 depends from surface 28. Skirt 30 has knurlings 32 on the exterior thereof. The knurlings 32 may extend over at least a portion of the top 28, preferably in a region closer to the skirt as shown in FIG. 4. A lip 34 is disposed on the exterior of the bottom edge of skirt 30, and a plurality of lugs or tabs 36 extend inwardly from the interior of skirt 30. Tabs 36 are configured to engage angled surfaces 24 and seat within recesses 26.

It is preferred that there be a plurality of tabs 36, spaced to mate with the plurality of recesses 26. In the preferred embodiment, there are five equally distributed tabs 36. However, the number and positioning is a matter of design choice, and it could be possible to employ, if the application calls for it, a number of tabs which is different than the number of recesses.

Extending downwardly from top 28 are a plurality of spring elements in the form of resilient fingers 38. Fingers 38 are generally V-shaped or triangular, and their respective apices 40 are positioned so that they touch shoulder 20 of container 14 when closure 12 and container 14 are joined together and at rest (FIG. 5).

Closure 12 further includes an annular flange 42 which extends downwardly from the underneath of top 28, and is configured to fit within lip 22 of container 14 when closure 12 and container 14 are joined together.

In use, closure 12 may be attached to container 14 as follows: Closure 12 is placed atop container 14 and tabs 36 are aligned in the spaces between adjacent angled surfaces 24. Thereafter, a downward force is applied to the top. This downward force causes apices 40 of fingers 38 to contact shoulder 20 of container 14. Closure 12 can then be rotated (preferably clockwise when viewed from the top), by gripping knurlings 32 and twisting closure 12 about axis 16. This motion causes tabs 36 to contact the undersides of surfaces 24 and travel downwardly along surfaces 24 until they reach recesses 26. This rotation and attendant travel of tabs 36 along surfaces 24 causes fingers 38 to extend upwardly in a direction parallel to axis 16, and through holes 44 in top 28, until tabs 36 reach recesses 26. When tabs 36 reach this point (shown in FIG. 5), resilient fingers 38 provide a spring action in a direction parallel to axis 16, which urges closure 12 upwards, and tabs 36 are forced to seat within recesses 26, securing closure 12 and container 14 together (FIG. 5). In this position, apices 40 engage the top of shoulder 20. Closure 12 and container 14 are now securely attached to one another. In this position, flange 42 rests inside of shoulder 18, providing some protection against the infiltration of air and contaminants through the connection.

When attached as described, closure 12 and container 14 are not easily separated by children, but may easily be separated by adults, as follows. To separate closure 12 and container 14, the user may simply push down on top 28, causing resilient fingers 38 to flex upwardly, and tabs 36 to disengage from recess 26. The pressure may be exerted by pushing down on closure 12 with the palm of the hand while holding the container 14 or placing the container on a flat surface, such as a table and pushing closure 12 down. In either event, closure 12 may then be rotated in the opposite direction (preferably counter-clockwise when viewed from the top) until tabs 36 clear surfaces 24 and reach the spaces therebetween, at which point closure 12 and container 14 may be disengaged, and the interior of container 14 may be accessed.

In some embodiments, fingers 38 may extend above top 28 when closure 12 is pressed down to remove closure 12 from container 14, but this is not preferred, and the precise configuration is a mere matter of design choice.

This combination therefore provides an easy and simple way to affix a closure to a medicine container in a way not heretofore practiced.

The closure and container are not only easy to use, but they are also easy to manufacture, since their construction lends itself to injection molding of the components. Any suitable plastic of moldable material may be used, although it is presently preferred to use polypropylene as it is the most cost effective material.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A child resistant closure for releasable securement to a container having a container lip, the container lip including a plurality of recesses, the container being substantially cylindrical and defining an axis, the closure comprising:

a top having a hole;

a skirt depending from the top and having a bottom edge;

a plurality of lugs positioned on the skirt proximate the bottom edge, each of the lugs being configured to mate with a respective recess on the container lip; and a spring formed in the top and depending therefrom in a direction of the lugs, the spring being urged away from the recesses and into the hole as the closure is releasably secured to the container;

whereby the axial movement of the spring causes each of the lugs to seat in its respective recess and thereby secure the closure to the container.

2. The closure of claim 1 wherein said spring is configured as at least one resilient finger.

3. The closure of claim 2, wherein each said resilient finger is substantially V-shaped, with the apex of the "V" positioned generally towards said lugs.

4. The closure of claim 2, wherein each said resilient finger is substantially triangular, with the apex of the triangle positioned generally towards said lugs.

5. The closure of claim 1, wherein said spring is mounted to said top.

6. The closure of claim 1, wherein each of said lugs is a tab configured to engage its respective recess.

7. The closure of claim 1, further comprising a flange positioned on said top and extending in a direction substantially parallel to the axis of the container and towards the recesses, said flange being positioned to fit inside the lip of the container.

8. The closure of claim 1, wherein the container includes a shoulder at the lip of the container, and said spring is positioned to engage the shoulder.

9. A closure and container combination comprising:

a substantially cylindrical container, said container having an axis and including a container lip at one end, said container lip having a plurality of recesses opening in a direction substantially parallel to said axis, and away from said one end; and a closure, rotatable about said axis, said closure including:

a top having a hole;

a skirt depending from the top and having a bottom edge;

a plurality of lugs positioned on the skirt and proximate the bottom edge, each of the lugs being configured to mate with a respective recess on the container lip; and a spring formed in the top and depending therefrom in a direction of the lugs, the spring being urged away from the recesses and into the hole as the closure is releasably secured to the container;

whereby the axial movement of the spring causes each of the lugs to seat in its respective recess and thereby secure the closure to the container.

10. The combination of claim 9 wherein said spring is configured as at least one resilient finger.

11. The combination of claim 10, wherein each said resilient finger is substantially V-shaped, with the apex of the "V" positioned towards said lugs.

12. The combination of claim 10, wherein each said resilient finger is substantially triangular, with the apex of the triangle positioned towards said lugs.

13. The combination of claim 9, wherein said spring is mounted to said top.

14. The combination of claim 9, wherein each of said lugs a tab is configured to engage its respective recess.

15. The combination of claim 9, further comprising a flange positioned on said top and extending in a direction substantially parallel to said axis of said container and towards said recesses, said flange being positioned to fit inside said lip.

16. The combination of claim 9, wherein said container includes a shoulder positioned inside said lip, and said spring is positioned to engage said shoulder.

17. The combination of claim 9, wherein said lip includes a plurality of angled surfaces, each of which slopes downwardly away from said one end of said container and opens into a respective one of said recesses.

18. The combination of claim 9, wherein said lugs extend radially inwardly from said skirt.

19. The combination of claim 18, further comprising a series of knurlings on the exterior of said skirt.

20. The combination of claim 19, wherein said knurlings extend over at least a portion of the upper surface of said top.

* * * * *